US010544643B2

(12) United States Patent
Roesner et al.

(10) Patent No.: US 10,544,643 B2
(45) Date of Patent: Jan. 28, 2020

(54) HYDRAULIC FRACTURING SYSTEMS AND METHODS

(71) Applicant: Cameron International Corporation, Houston, TX (US)

(72) Inventors: Thomas G. Roesner, Houston, TX (US); Bruce A. Hogg, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/689,515

(22) Filed: Aug. 29, 2017

(65) Prior Publication Data

US 2018/0058171 A1 Mar. 1, 2018

Related U.S. Application Data

(60) Provisional application No. 62/380,878, filed on Aug. 29, 2016.

(51) Int. Cl.

| | |
|---|---|
| ***E21B 33/068*** | (2006.01) |
| ***E21B 34/02*** | (2006.01) |
| ***E21B 43/26*** | (2006.01) |

(52) U.S. Cl.

CPC ..... *E21B 33/068* (2013.01); *E21B 34/02* (2013.01); *E21B 43/26* (2013.01)

(58) Field of Classification Search

CPC ..... E21B 33/068; E21B 34/02; E21B 43/26

USPC ..... 166/308.1

See application file for complete search history.

(56) References Cited

U.S. PATENT DOCUMENTS

| | | | | |
|---|---|---|---|---|
| 2009/0120635 | A1 | 5/2009 | Neal | |
| 2012/0037356 | A1 | 2/2012 | Guidry | |
| 2013/0284455 | A1* | 10/2013 | Kajaria | E21B 43/26 166/379 |
| 2013/0306304 | A1* | 11/2013 | Cherewyk | E21B 43/26 166/90.1 |
| 2016/0168970 | A1 | 6/2016 | Kajaria et al. | |

OTHER PUBLICATIONS

International Search Report and Written Opinion dated Nov. 16, 2017, for International Patent Application No. PCT/US2017/049096.

* cited by examiner

*Primary Examiner* — Anna M Momper
*Assistant Examiner* — Patrick F Lambe
(74) *Attorney, Agent, or Firm* — Conley Rose, P.C.

(57) ABSTRACT

A well stimulation system includes an inlet fluid conduit connected to a manifold, and a first wellhead assembly connected to the manifold, wherein the wellhead assembly includes a frac tree, a wellhead coupled to the frac tree, wherein the wellhead is in fluid communication with a first well, wherein the frac tree of the first wellhead assembly is configured to inlet a stimulation fluid from the manifold to the first well along a first fluid flowpath extending through the frac tree, wherein the frac tree of the first wellhead assembly is configured to outlet well fluid from the first well to the manifold along the first fluid flowpath.

20 Claims, 12 Drawing Sheets

HYDRAULIC FRACTURING SYSTEMS AND METHODS

BACKGROUND

In order to meet consumer and industrial demand for natural resources, companies may invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems may include a wellhead assembly through which the resource is extracted. These wellhead assemblies may include a wide variety of components, such as various casings, valves, fluid conduits, and the like, that control drilling or extraction operations.

In some applications, wellhead assemblies of drilling and production systems may use fracturing trees and other components to facilitate a fracturing process and enhance production from wells. As will be appreciated, resources such as oil and natural gas may be extracted from fissures or other cavities formed in various subterranean rock formations or strata. To facilitate extraction of such a resource, a well may be subjected to a fracturing process that creates one or more man-made fractures in a rock formation. This facilitates, for example, coupling of pre-existing fissures and cavities, allowing oil, gas, or the like to flow into the wellbore. In some applications, fracturing processes use large pumps to inject a fracturing fluid, such as a mixture of sand and water, into the well to increase the well's pressure and form the man-made fractures. In certain applications, fracturing system includes a fracturing manifold trailer (also known as a missile trailer) with pipes for routing fracturing fluid to and from the large pumps. Other pipes connected to the output of the manifold trailer carry the fracturing fluid to the well. Once fracturing—whether for a stage or for the entire well—is completed, the fracturing fluid may be routed back to the surface to prepare the well for production—a process often described as "flowback". Coordinating fracturing and flowback can be, particularly for a multipad well, a time consuming process.

SUMMARY

An embodiment of a well stimulation system, comprises an inlet fluid conduit connected to a manifold; and a first wellhead assembly connected to the manifold, wherein the wellhead assembly comprises a frac tree; a wellhead coupled to the frac tree, wherein the wellhead is in fluid communication with a first well; wherein the frac tree of the first wellhead assembly is configured to inlet a stimulation fluid from the manifold to the first well along a first fluid flowpath extending through the frac tree; wherein the frac tree of the first wellhead assembly is configured to outlet well fluid from the first well to the manifold along the first fluid flowpath. In some embodiments, the first fluid flowpath extending through the frac tree of the first wellhead assembly comprises a plurality of fluid connections, and wherein each fluid connection comprises a flanged connection. In some embodiments, the well stimulation system further comprises a fluid processing system connected to the manifold, wherein the fluid processing system is configured to process well fluid from the first well. In certain embodiments, the frac tree comprises a connector block; a lower valve coupled to the connector block; an upper valve coupled to the connector block in series with the lower valve; and a branch valve coupled to the connector block, wherein the branch valve is coupled to the connector block between the lower valve and the upper valve. In certain embodiments, the first fluid flowpath extends between the branch valve and the lower valve of the frac tree. In some embodiments, the upper valve of the frac tree is configured to allow for the passage of a tubular member through the frac tree into the first well. In some embodiments, the frac tree comprises a cap coupled to the upper valve. In certain embodiments, the frac tree comprises a hammer union adapter coupled to with the connector block.

An embodiment of a well stimulation system comprises an inlet fluid conduit connected to a manifold; and a first wellhead assembly connected to the manifold, wherein the wellhead assembly comprises a first frac tree; a first wellhead coupled to the first frac tree, wherein the first wellhead is in fluid communication with a first well; wherein the first frac tree is configured to inlet a stimulation fluid from the manifold to the first well along a first fluid flowpath that comprises a plurality of fluid connections, wherein each fluid connection comprises a flanged connection. In some embodiments, the first frac tree is configured to outlet well fluid from the first well to the manifold along the first fluid flowpath. In some embodiments, the well stimulation system further comprises a second wellhead assembly connected to the manifold, wherein the second wellhead assembly comprises a second frac tree; and a second wellhead coupled to the second frac tree, wherein the second wellhead is in fluid communication with a second well; wherein the second frac tree is configured to inlet a stimulation fluid from the manifold to the second well along a second fluid flowpath that comprises a plurality of fluid connections, wherein each fluid connection comprises a flanged connection. In certain embodiments, both the first and second flowpaths extend through the manifold. In certain embodiments, the well stimulation system further comprises a fluid processing system connected to the manifold, wherein the fluid processing system is configured to process well fluid from the first well and the second well. In some embodiments, the well stimulation system further comprises a first fluid processing conduit extending between the manifold and the fluid processing system, wherein the first fluid processing conduit is configured to supply the fluid processing system with well fluid from the first well. In some embodiments, the well stimulation system further comprises a second fluid processing conduit extending between the second frac tree and the fluid processing system, wherein the second fluid processing conduit is configured to supply the fluid processing system with well fluid from the second well. In certain embodiments, the first frac tree comprises a connector block; a lower valve coupled to the connector block; an upper valve coupled to the connector block in series with the lower valve; and a branch valve coupled to the connector block, wherein the branch valve is coupled to the connector block between the lower valve and the upper valve. In certain embodiments, the first fluid flowpath extends between the branch valve and the lower valve of the first frac tree.

An embodiment of a method for stimulating a well comprises flowing a stimulation fluid into the well through a first fluid flowpath extending through a frac tree; and flowing a well fluid out of the well through the first fluid flowpath that extends through the frac tree. In some embodiments, the first fluid flowpath comprises only flanged fluid connections. In some embodiments, the method further comprises flowing the stimulation fluid through a branch valve of the frac tree, a connector block of the frac tree, and a lower valve of the frac tree along the first fluid flowpath.

BRIEF DESCRIPTION OF THE DRAWINGS

For a detailed description of exemplary embodiments, reference will now be made to the accompanying drawings in which.

DETAILED DESCRIPTION

Figure 1:
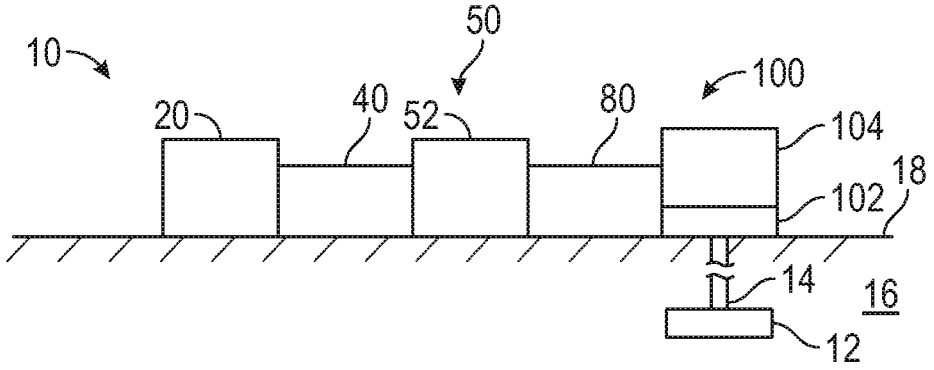
FIG. 1 is a schematic view of an embodiment of a hydraulic fracturing system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1, an embodiment of a well stimulation or hydraulic fracturing system 10 is shown schematically. Fracturing system 10 facilitates the extraction of natural resources (e.g., oil, natural gas, etc.) from a reservoir 12 via a well 14. Particularly, by injecting a fracturing fluid down well 14 into the reservoir 12, the system 10 increases the number or size of fractures in a subterranean earthen formation 16 to enhance recovery of natural resources present in the formation. In the embodiment shown in FIG. 1, well 14 comprises a surface well coupled to a fracturing fluid delivery and retrieval system 50 of fracturing system 10 that is disposed at surface level (i.e., on ground 18). However, in other embodiments, natural resources may be extracted from other wells, such as platform or subsea wells.

In the embodiment shown in FIG. 1, hydraulic fracturing system 10 generally includes a fracturing fluid supply system 20, and a fracturing fluid delivery system 50. In this embodiment, fracturing fluid delivery system 50 generally includes a fracturing fluid manifold assembly 52 and one or more wellhead assemblies 100 via one or more fluid conduits or connectors 80 (e.g., a frac iron, etc.) extending therebetween. As shown schematically in FIG. 1, wellhead assembly 100 of fracturing system 10 generally includes a wellhead 102 secured to the surface and a frac tree 104 coupled to wellhead 102. Although wellhead assemblies 100 are shown in FIG. 1 as only including wellhead 102 and frac tree 104, each wellhead assembly 100 of fracturing system 10 may include additional components not shown in FIG. 1. Supply system 20 of hydraulic fracturing system 10 is generally configured to provide a supply of fracturing fluid to fracturing fluid delivery system 50 via an inlet fluid conduit or connection 40 extending therebetween, where inlet fluid conduit 40 may extend above or below ground 18.

Figure 2:
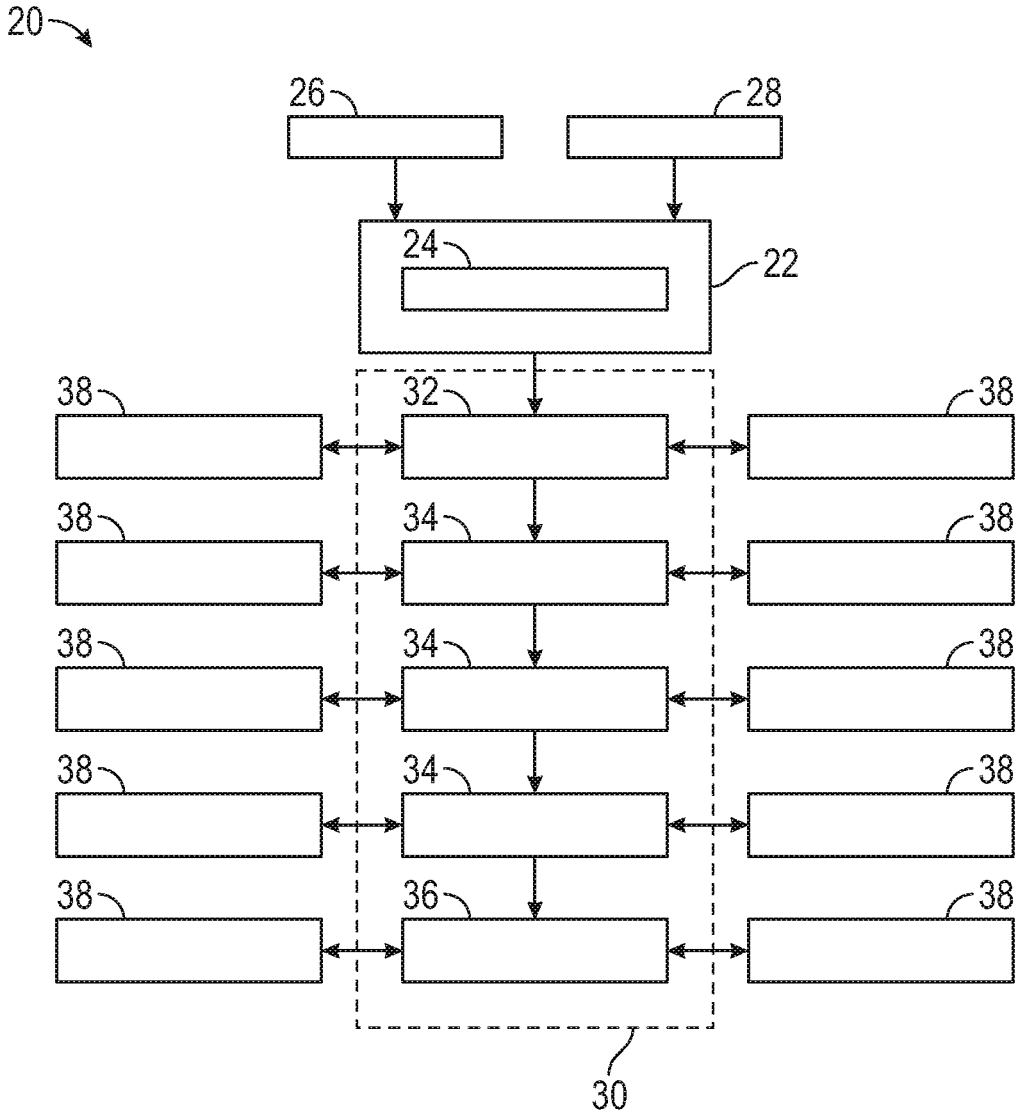
FIG. 2 is a schematic view of an embodiment of a fracturing fluid supply system of the fracturing system shown in FIG. 1 in accordance with principles disclosed herein.

In the embodiment shown in FIG. 2, supply system 20 generally includes a blending unit 22 in fluid communication with a manifold or missile trailer 30, and a plurality of pumps 38 also in fluid communication with missile trailer 30. Additionally, in the embodiment shown in FIG. 2, missile trailer 30 generally includes a suction unit 32, a plurality of pump units 34, and a discharge unit 36. While in this embodiment units 32, 34, and 36 are positioned on missile trailer 30, in other embodiments, units 32, 34, and 36 may comprise separate skids for placement on the ground 18. Blending unit 22 of supply system 20 comprises one or more blenders 24 configured to produce a fracturing or stimulation fluid by mixing a fluid 26 (e.g., water, etc.) with various additives 28, such as proppant (e.g., sand, etc.) and additive chemicals. Once blended in the blenders 24 of blending unit 22, the blended fracturing fluid may flow from blending unit 22 to pumps 38 of supply system via units 32, 34, and 36 disposed on missile trailer 30. In some embodiments, the blending unit 22 is provided at a wellsite with units 32, 34, and 36; however in other embodiments, blending unit 22 may be disposed at a remote location distal the wellsite and units 32, 34, and 36.

In some embodiments, blending unit 22 may also be used to provide other fluids 26, such as a different well stimulation fluid (e.g., an acid or solvent), through units 32, 34, and 36 of missile trailer 30 to the pumps 38. Although in this embodiment system 10 comprises a hydraulic fracturing system, it will be appreciated that hydraulic fracturing system 10 and its components may also or instead be used to deliver other stimulation fluids into the well. Thus, hydraulic fracturing system 10 may also comprise a well stimulation system 10. Additionally, while various conduits and operations of the system 10 are described with reference to fracturing fluids by way of example, the conduits and operations described may also be used with other well stimulation fluids.

Pumps 38 of fracturing fluid supply system 20 may take any suitable form, and may include truck-mounted pumps or skid-mounted pumps. Regardless of their form, pumps 38 are generally configured to increase the pressure of the fracturing fluid (or other fluid) received from blending unit 22 via units 32, 34, and 36, each of which are in fluid communication with a pair of corresponding pumps 38. Particularly, a pair of pumps 38 is disposed adjacent each unit 32, 34, and 36 of missile trailer 30. Low pressure fracturing fluid is received by suction skid 32 and is routed to one or more of pumps 38 to pressurize the fracturing fluid before routing the high pressure fracturing fluid to discharge skid 36.

Pump units 34 are configured to assist in the routing of low pressure and high pressure fracturing fluid to and from one or more pumps 38 as the fracturing fluid is routed between suction unit 32 and discharge unit 36. In some embodiments, each unit 32, 34, and 36 includes a low pressure conduit (not shown) for transporting low pressure fracturing fluid to one or more pumps 38, and a high pressure conduit (not shown) for routing high pressure fracturing fluid received from a pump 38. In this arrangement, units 32, 34, and 36 are disposed in series while pumps 38 are disposed in parallel respective units 32, 34, and 36. Discharge unit 36 of missile trailer 30 is configured to receive high pressure fracturing fluid from pumps 38 and/or a pump unit 34 and supply the high pressure fracturing fluid to fluid manifold assembly 52 of fluid delivery system 50 via inlet fluid conduit 40 (not shown in FIG. 2).

Referring to FIGS. 1 and 3-5, fracturing fluid delivery system 50 is configured to receive the high pressure fracturing fluids supplied by fracturing fluid supply system 20 and deliver the fracturing fluids to one or more wells 14 of hydraulic fracturing system 10. As will be discussed further herein, fracturing fluid delivery system 50 is also configured to receive and route flow-back or wellbore fluids supplied by the one or more wells 14 of fracturing system 10 following the hydraulic fracturing of the one or more wells 14. Although in this embodiment fracturing fluid delivery system 50 receives high pressure fracturing fluids from supply system 20, in other embodiments, delivery system 50 may receive varying well stimulation fluids, including fluids other than fracturing fluids and disposed at varying fluid pressures, from correspondingly varying supply systems.

Figure 3:
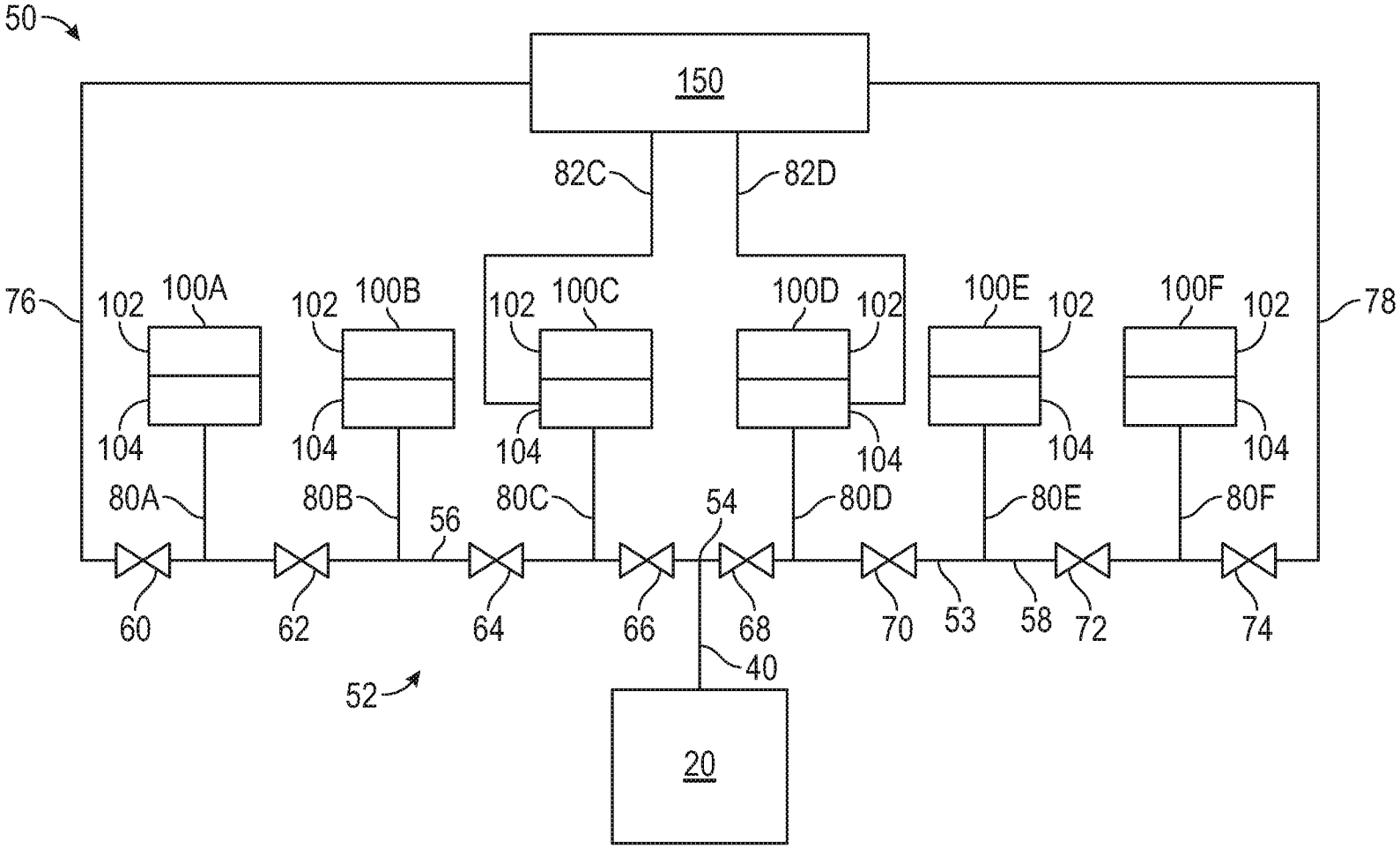
FIG. 3 is a schematic view of an embodiment of a fracturing fluid delivery system of the hydraulic fracturing system shown in FIG. 1 in accordance with principles disclosed herein.
Figure 4:
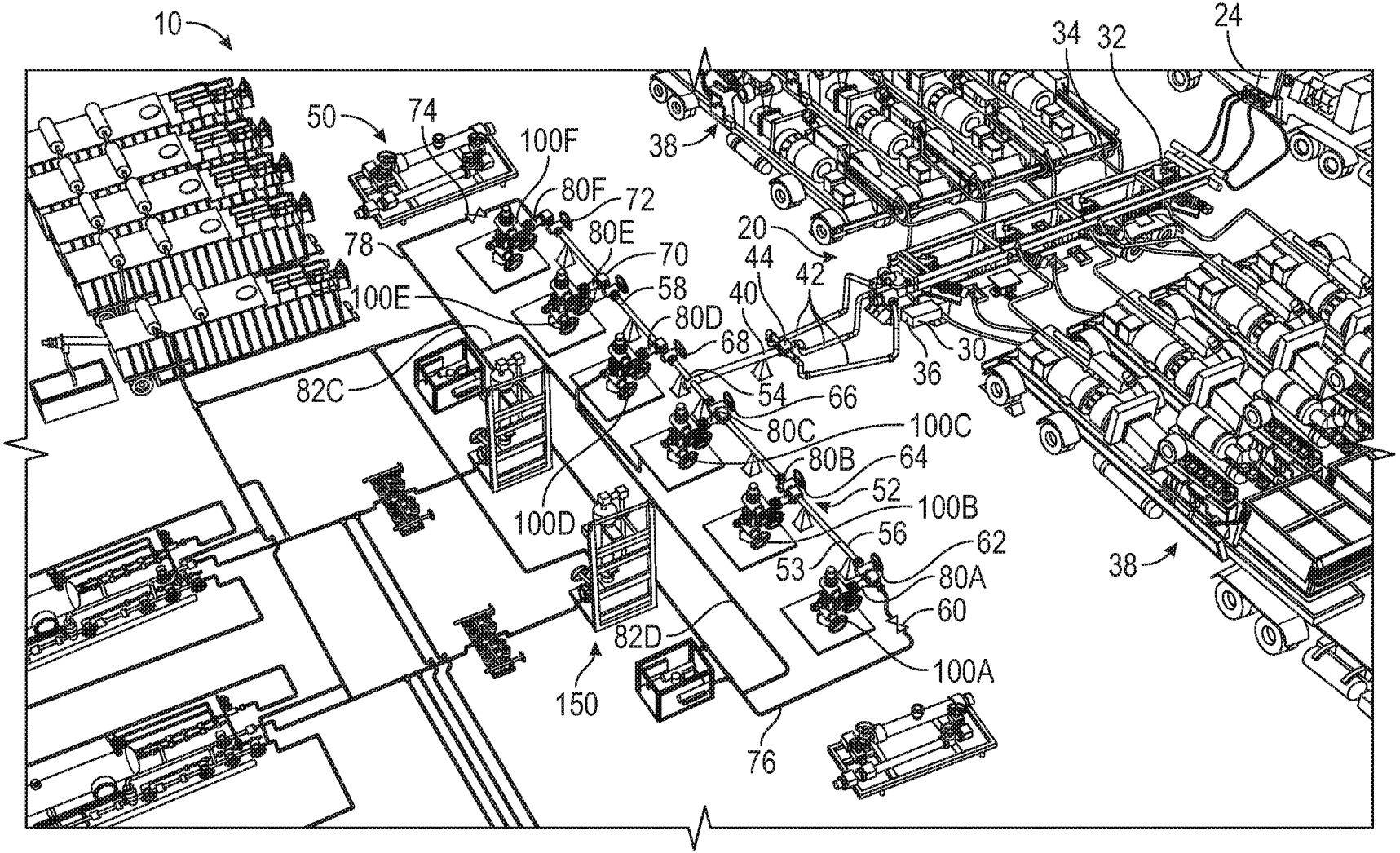
FIG. 4 is a first perspective view of the fracturing fluid delivery system shown in FIG. 3.
Figure 5:
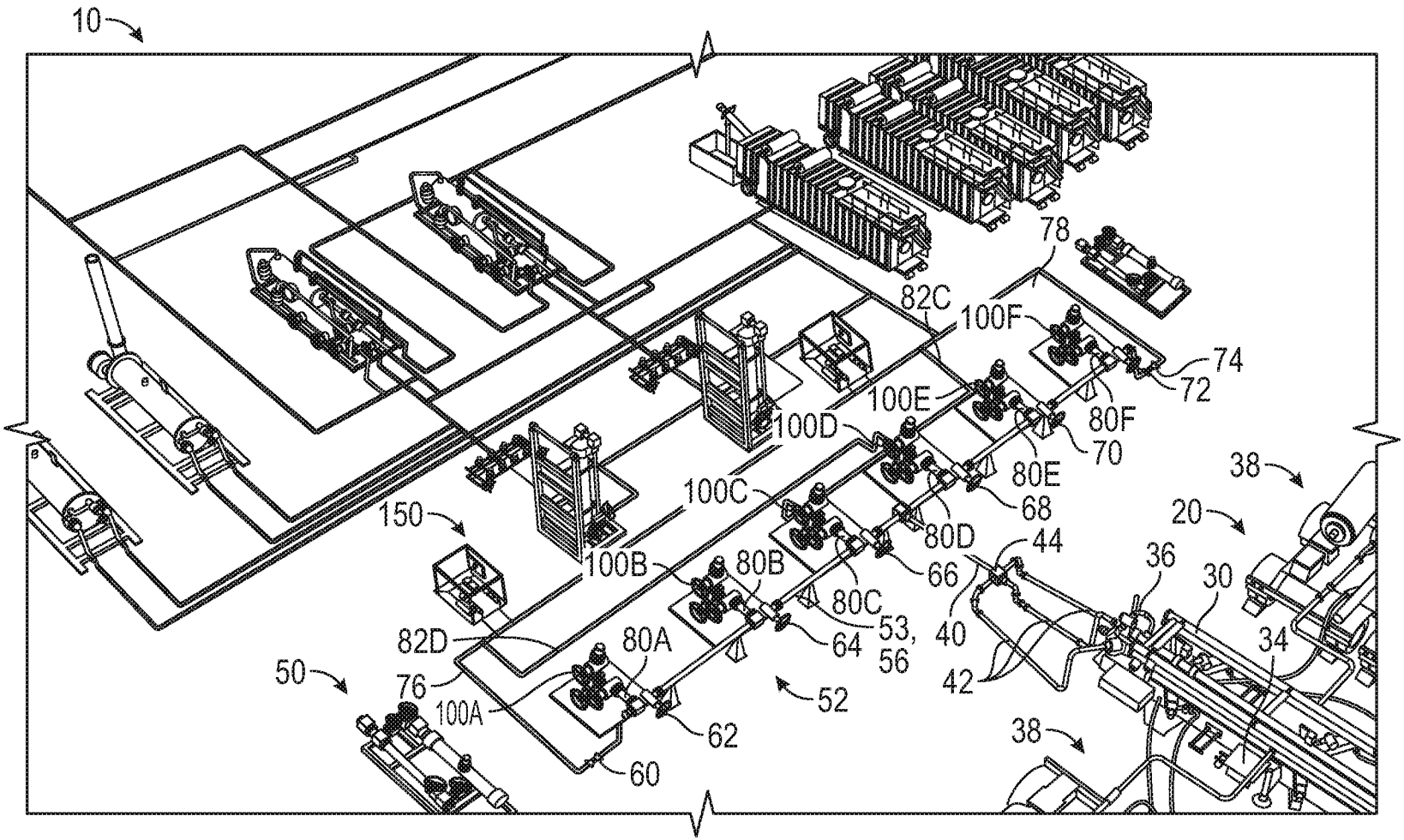
FIG. 5 is a second perspective view of the fracturing fluid delivery system shown in FIG. 3.

In the embodiment shown in FIGS. 3-5, fracturing fluid delivery system 50 generally includes manifold assembly 52, a plurality of wellhead assemblies 100 (shown as wellhead assemblies 100A-100F in FIGS. 3-5) in fluid communication with manifold assembly 52, and a fluid processing system 150 in fluid communication with manifold assembly 52 and wellhead assemblies 100C and 100D of the plurality of wellhead assemblies 100A-100F. Each wellhead assembly 100A-100F is in fluid communication with a corresponding well 14 (not shown in FIGS. 3-5) disposed beneath the wellhead 102 of the particular wellhead assembly 100A-100F. In this arrangement, each wellhead assembly 100A-100F is configured to provide for the injection of fluids into the corresponding well 14 from manifold assembly 52 and for the retrieval or flow of fluids from the well 14 of each wellhead assembly 100A-100F to the manifold assembly 52 and fluid processing system 150, as will be discussed further herein. Although the embodiment of fracturing fluid delivery system 50 includes six wellhead assemblies 100A-100F, in other embodiments, fracturing fluid delivery system may include varying numbers of wellhead assemblies 100, including a single wellhead assembly 100 servicing a single well 14.

Fracturing manifold assembly 52 of fracturing fluid delivery system 50 is generally configured to route fluids to and from wellhead assemblies 100A-100F and fluid processing system 150. In the embodiment shown in FIGS. 3-5, manifold assembly 52 generally includes a fluid manifold 53 comprising an inlet 54, a first branch line or conduit 56 extending from inlet 54 in a first direction, and a second branch line or conduit 58 extending from inlet 54 in a second direction. Manifold assembly 52 may also include structures or mounts for physically supporting the components of assembly 52. Inlet 54 of manifold 53 is connected with inlet fluid conduit 40 and is configured to receive high pressure fracturing fluids from fracturing fluid supply system 20. As shown particularly in FIGS. 4 and 5, in this embodiment a plurality of discharge fluid conduits 42 extend from discharge unit 36 of supply system 20 and connect with a discharge manifold 44 that is spaced from the missile trailer 30 of supply system 20. In turn, discharge manifold 44 is connected with inlet fluid conduit 40 to provide for fluid communication between discharge unit 36 of fracturing fluid supply system 20 and the inlet 54 of manifold 53. Although in the embodiment shown in FIGS. 4 and 5, discharge manifold 44 is connected between discharge fluid conduits 42 and inlet fluid conduit 40, in other embodiments, inlet fluid conduit 40 may extend directly between inlet 54 of manifold 53 and an outlet of discharge unit 36 of fracturing fluid supply system 20.

Each wellhead assembly 100A-100F is in fluid communication or fluidly connected with a branch line 56 or 58 of manifold 53 through a corresponding fluid conduit 80 (shown as 80A-80F in FIGS. 3-5). Additionally, manifold assembly 52 includes a plurality of actuatable valves 60-74 disposed along branch lines 56 and 58 of manifold 53. In some embodiments, valves 60-74 comprise gate valves, while in other embodiments, valves 60-74 may comprise other valves known in the art configured to provide a sealable barrier. Valves 60-74 are positioned along manifold 53 to assist in routing fracturing and flowback fluids to and from the individual wells 14 of fracturing fluid delivery system 50, as will be discussed further herein. In the embodiment shown in FIGS. 3-5, valve 60 is disposed at or near the terminal end of first branch line 56 while valve 74 is disposed at or near the terminal end of second branch line 58. Additionally, valve 62 is disposed between the connection points of fluid conduits 80A and 80B with first branch line 56, valve 64 is disposed between the connection points of fluid conduits 80B and 80C with first branch line 56, and valve 66 is disposed between the connection point of fluid conduit 80C with first branch line 56 and inlet 54. Further, valve 68 is disposed between inlet 54 and the connection point of fluid conduit 80D with second branch line 58, valve 70 is disposed between the connection points of fluid conduits 80D and 90E with second branch line 58, and valve 72 is disposed between the connection points of fluid conduits 80E and 80F with second branch line 58.

Fluid processing system 150 is configured to process flowback or wellbore fluids from the wells 14 of fracturing fluid delivery system 50 following the hydraulic fracturing of one or more wells 14. Fluid processing system 150 is generally configured to process the received flowback fluids such that the flowback fluids may be safely and economically transported to a remote location. For instance, in some embodiments, fluid processing system 150 comprises equipment configured to remove sand, hydrocarbons, or other contaminants disposed in the received flowback fluid. In the embodiment shown in FIGS. 3-5, fluid processing system 150 is placed in fluid communication or fluidly connected with manifold assembly 52 via a pair of fluid processing conduits 76 and 78 extending therebetween. Particularly, a first fluid processing conduit 76 extends between the terminal end of first branch line 56 of manifold 53 and fluid processing system 150 while a second fluid processing conduit 78 extends between the terminal end of second branch line 58 of manifold 53 and fluid processing system 150. Additionally, a fluid processing conduit 82C extends between the frac tree 104 of wellhead assembly 100C and fluid processing system 150, and a fluid processing conduit 82D extends between the frac tree 104 of wellhead assembly 100D and fluid processing system 150. Although in the embodiment shown in FIGS. 3-5 wellhead assemblies 100C and 100D are fluidly connected with fluid processing system 150 with fluid processing conduits 82C and 82D, respectively, in other embodiments other wellhead assemblies 100A, 100B, 100E, and/or 100F may include fluid processing conduits fluidly connected to fluid processing system 150.

Referring to FIGS. 3-6, an embodiment of frac tree 104 used in wellhead assemblies 100A-100F is shown. In the embodiment shown in FIG. 6, frac tree 104 generally includes a first or lower valve 106, a block connector 108, a branch or wing valve 110, a hammer union adapter 112, a second or upper valve 114, and a cap 116. In this embodiment, valves 106, 110, and 114 comprise gate valves; however, in other embodiments, valves 106, 110, and 114 may comprise other valves known in the art configured to provide a sealable barrier. In the arrangement shown in FIG. 6, lower valve 106 and upper valve 114 are connected in series with connector block 108 while branch valve 110 is connected in parallel between lower valve 106 and upper valve 114. Additionally each valve 106, 110, and 114 comprises a pair of flanged connectors 106F, 110F, and 114F disposed at the terminal ends thereof for providing a flanged connection with connector block 108 and fluid conduits connected with frac tree 104. Particularly, a flanged connector 110F of branch valve 110 provides a flanged connection with fluid conduit 80 (e.g., fluid conduit 80A of the frac tree 104 of wellhead assembly 100A, etc.). In the embodiment shown in FIG. 6, the flanged connectors 106F, 110F, and 114F of valves 106, 110, and 114, respectively, comprise American Petroleum institute (API) 6A flanges; however, in other embodiments, flanged connectors 106F, 110F, and 114F may comprise varying specifications.

Figure 6:
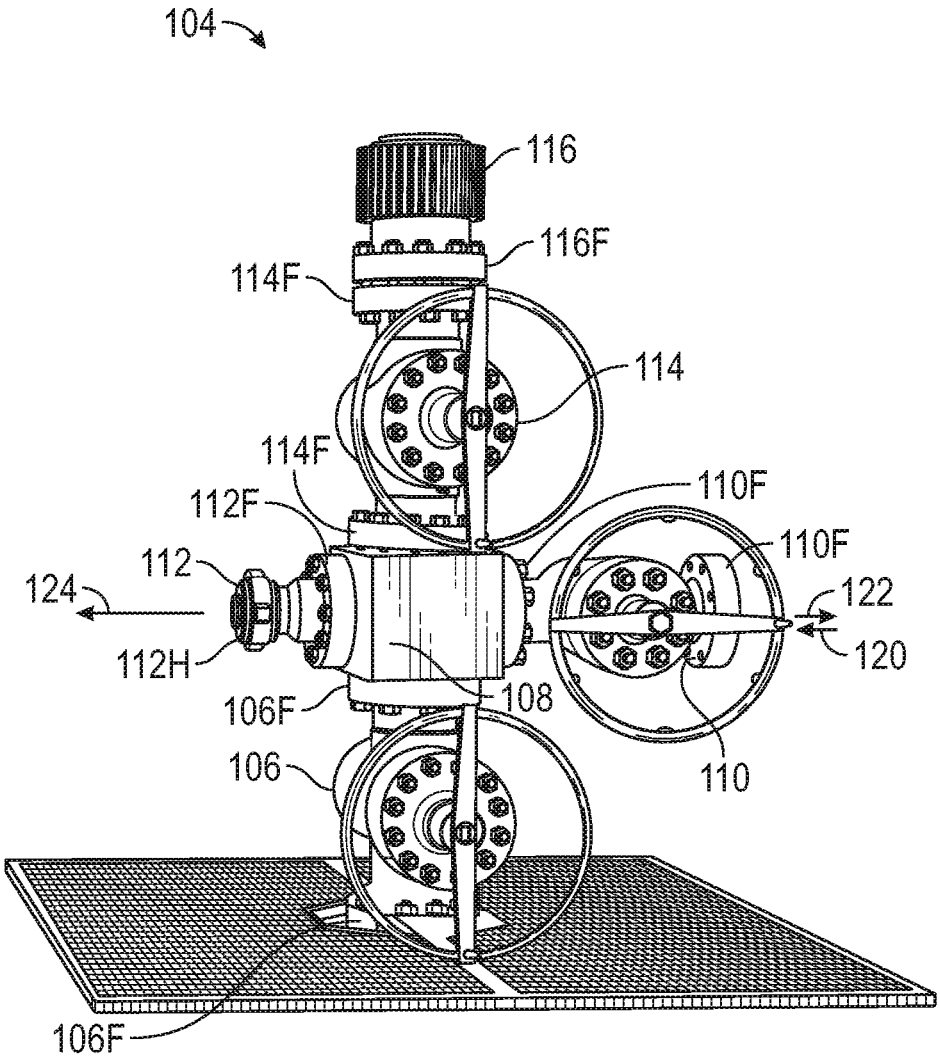
FIG. 6 is a perspective view of an embodiment of a frac tree of the fracturing fluid delivery system shown in FIG. 3 in accordance with principles disclosed herein.

In the embodiment of frac tree 104 shown in FIG. 6, hammer union adapter 112 comprises a flanged connector 112F coupled with connector block 108 and a hammer union connector 112H for coupling with a fluid conduit via a hammer union connection. In the embodiment shown in FIGS. 3-5, the frac tree 104 of wellhead assemblies 100C and 100D couple with fluid processing conduits 82C and 82D, respectively, via the hammer union connector 112H of their respective hammer union adapters 112. Hammer union connectors, such as hammer union connector 112H of hammer union adapter 112 provide a relatively quick means for forming a fluid connection, such as with temporary pipework. However, hammer unions, which in some applications are made up or formed using a sledge hammer or similar tool, do not allow for the price application of a predetermined torque when forming the connection as do flanged connections. Additionally, hammer unions do not provide a positive indication of a successful connection as do flanged connections, and thus, are susceptible to the formation of mismatched connections in the field. Further, in some applications hammer unions rely on elastomeric seals for sealing the formed fluid connection, while flanged connections may include more reliable metal-to-metal seals.

In the embodiment shown in FIG. 6, cap 116 of frac tree 104 is also provided with a flanged connection 116F for coupling with upper valve 114. In this embodiment, upper valve 114 is configured to allow for the passage of a tubular member or string into frac tree 104 for intervention into the corresponding well 14. In some embodiments, sensors or other monitoring equipment may be mounted to cap 116 for sensing properties of fluid disposed in frac tree 104 and the well 14 in fluid communication therewith. In other embodiments, cap 116 is configured to allow for the passage of a tubular member or string into frac tree 104 for intervention into the corresponding well 14. In still other embodiments, cap 116 may be connected with a flowline for the providing of an additional flowpath into or out of frac tree 104 besides the flowpaths provided by branch valve 110 and hammer union adapter 112.

In some applications, the hydraulic fracturing of a well, such as wells 14 of hydraulic fracturing system 10, generally comprises a two-step process. First, a high pressure fracturing fluid is delivered to the well 14 to be fractured to create or propagate fractures in the subterranean formation 16 to assist increasing fluid connectivity or communication between the well 14 and the surrounding reservoir 12. In some applications, following the delivery of the high pressure fracturing fluid to the well 14, fluids from the fractured well 14 may flow back to the wellhead assembly 100 of the fractured well 14, where such "flowback" fluids may include fluids from the reservoir 12 surrounding fractured well 14, materials from the formation 16, and fracturing fluids injected into fractured well 14 during the fracturing operation. In some applications, the flowback fluids supplied by the fractured well 14 are provided to a fluid processing system for processing prior to transport to a location remote from the wellsite. Thus, in at least some hydraulic fracturing operations, the frac tree through which the fracturing operation of fractured well 14 is conducted must accommodate or provide for a fracturing fluid flowpath to the well 14 for delivering the fracturing fluids, and a flowback flowpath for flowback fluids flowing from the fractured well 14 following the delivery of the fracturing fluids thereto.

In the embodiment shown in FIG. 6, frac tree 104 is configured to provide a first or fracturing fluid delivery flowpath indicated by arrow 120 in FIG. 6 that extends from fluid conduit 80 (e.g., fluid conduit 80A for wellhead assembly 100A, etc.) into frac tree 104 via branch valve 110, through connecting block 108 and into the wellhead 102 via lower valve 106. Additionally, frac tree 104 is configured to provide a second or flowback fluid flowpath indicated by arrow 122 in FIG. 6 that extends from wellhead 102 into frac tree 104 via lower valve 106, through connecting block 108 and into fluid conduit 80 via branch valve 110. Thus, fracturing fluid flowpath 120 and flowback fluid flowpath 122 comprise the same route or flowpath through frac tree 104 but in opposing directions of fluid flow. Further, in certain embodiments, frac tree 104 is configured to provide a third or alternate flowback fluid flowpath indicated by arrow 124 in FIG. 6 that extends from wellhead 102 into frac tree 104 via lower valve 106, through connecting block 108 and into a fluid processing conduit 82 (e.g., fluid processing conduit 82C for the frac tree 104 of wellhead assembly 100C, etc.) via hammer union adapter 112.

As described above, frac tree 104 is configured to provide both a fracturing fluid delivery flowpath 120 and a flowback fluid flowpath 122 extending through only flanged fluid connections, such as fluid connections made up using API 6A flanges. In other words, fluid flowpaths 120 and 122 do not extend through a fluid connection formed via a hammer union. In this manner, frac tree 104 is configured to provide both a fracturing fluid delivery flowpath 120 to well 14 and a flowback fluid flowpath 122 from well 14 using precisely torqued fluid connections comprising reliable metal-to-metal seals. Additionally, the pipework (e.g., fluid conduit 80) for transporting the fracturing fluids and flowback fluids to and from frac tree 104 may be installed in a single process as only a single fluid conduit 80 is required for transporting the fracturing and flowback fluids to and from frac tree 104. In this manner, the overall time for performing the fracturing operation may be decreased as the pipework required for delivering the fracturing fluids to the frac tree need not be uninstalled following the delivery of the fracturing fluids, and it is not necessary to wait until the fracturing fluids have been delivered before installing the pipework necessary for transporting the flowback fluids from the frac tree.

Referring to FIGS. 3-6 and 7A-7F, hydraulic fracturing system 10 may be utilized to hydraulically fracture the wells 14 in fluid communication with wellhead assemblies 100A-100F of fracturing fluid delivery and retrieval system 50. Particularly, the hydraulic fracturing of wells 14 of system 10 may be initiated by pumping a high pressure fracturing fluid to manifold assembly 52 via fracturing fluid supply system 20. Prior to the inletting of pressurized fracturing fluid to manifold 53, valves 60 and 68 of manifold assembly 52 are closed and the branch valve 110 of the frac tree 104 of wellhead assemblies 100B and 100C are closed. As shown particularly in FIG. 7A, pressurized fracturing or stimulation fluid (indicated schematically by a dashed line 46 in FIGS. 7A-7F) is delivered to manifold assembly 52 via inlet fluid conduit 40 and directed into inlet 54 of manifold 53, through first branch line 56, and into frac tree 104 of wellhead assembly 100A via fluid conduit 80A. The pressurized fracturing fluid 46 is then delivered to the well 14 (shown in FIG. 1) in fluid communication with wellhead assembly 100A along the flowpath 120 shown in FIG. 6 to hydraulically fracture the well 14. Once a sufficient quantity of pressurized fracturing fluid 46 has been delivered to the well 14 of wellhead assembly 100A, the flow of fracturing fluid 46 to delivery system 50 from supply system 20 is ceased, valve 62 is closed and valve 60 is opened to allow flowback or well fluids (indicated schematically at 48 in FIGS. 7A-7F) communicated to wellhead assembly 100A from the fractured well 14 to flow into fluid processing system 150 via flowback fluid flowpath 122 of frac tree 104 and first fluid processing conduit 76, thereby completing the hydraulic fracturing of the well 14 of wellhead assembly 100A.

Figure 7A:
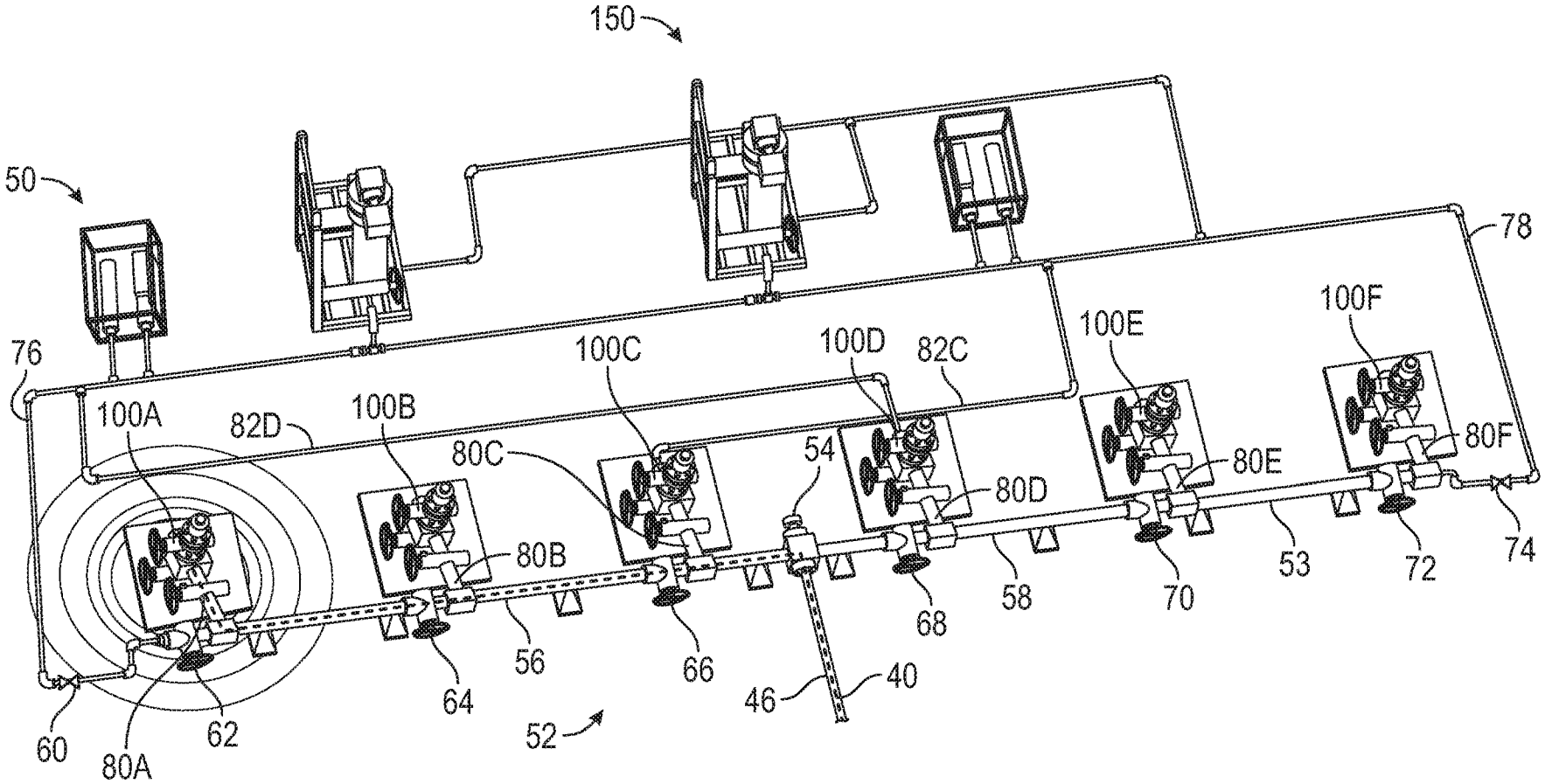
FIG. 7A is a perspective of the fracturing fluid delivery system of FIG. 3 shown in a first position.
Figure 7B:
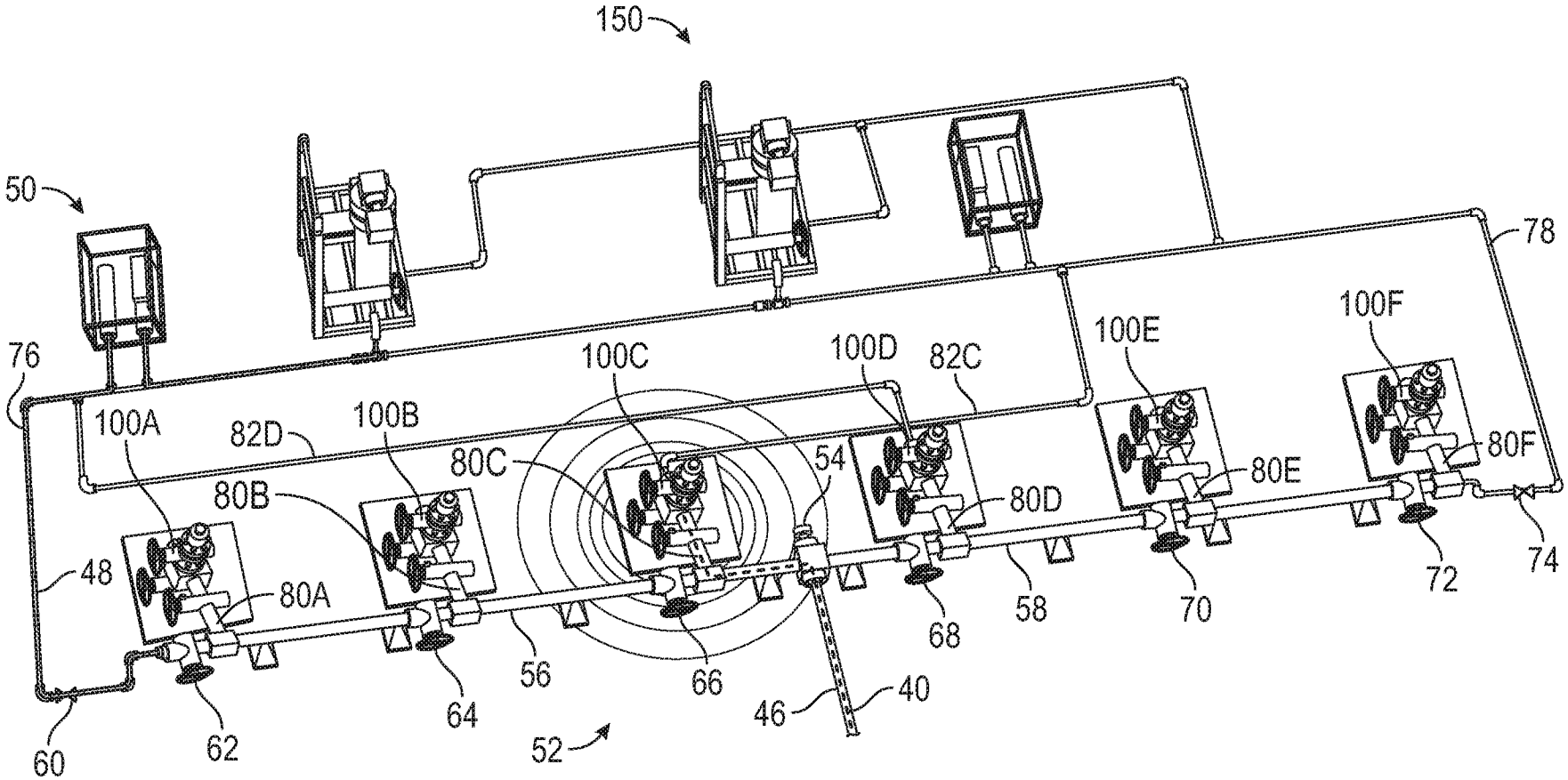
FIG. 7B is a perspective of the fracturing fluid delivery system of FIG. 3 shown in a second position.

As shown particularly in FIG. 7B, while flowback fluids are 48 flowing into fluid processing system 150 from wellhead assembly 100A, high pressure fracturing fluids 46 may be concurrently delivered to the well 14 of wellhead assembly 100C by inputting pressurized fracturing fluid 46 to manifold assembly 52 from supply system 20, closing valve 64 of first branch line 56, and opening the branch valve 110 of the frac tree 104 of wellhead assembly 100C. In this manner, the overall time required for hydraulically fracturing the wells 14 of fracturing system 10 may be reduced by concurrently inputting pressurized fracturing fluid 46 to one well assembly 100 (i.e., wellhead assembly 100C) while concurrently outputting flowback fluids 48 from a second well assembly 100 (i.e., wellhead assembly 100A).

Figure 7C:
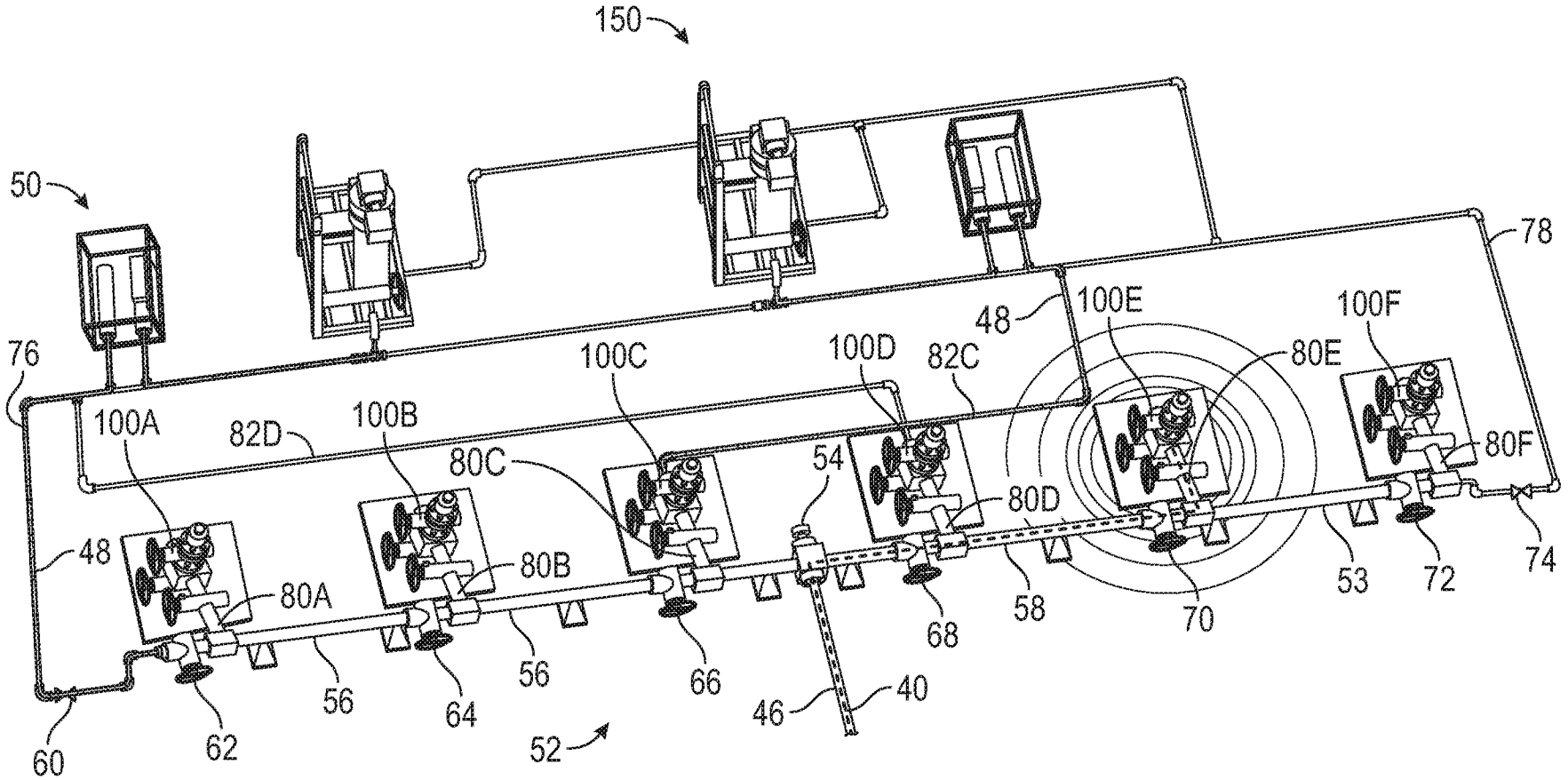
FIG. 7C is a perspective of the fracturing fluid delivery system of FIG. 3 shown in a third position.

As shown particularly in FIG. 7C, once a sufficient quantity of pressurized fracturing fluids 46 have been delivered to the well 14 of wellhead assembly 100C, valves 66 and 74 are closed (if valve 74 is not already closed) and the branch valve 110 of the frac tree 104 of wellhead assembly 100E is opened to deliver high pressure fracturing fluids 46 to the well 14 of wellhead assembly 100E via fracturing fluid flowpath 120. Concurrently, flowback fluid 48 is flowed to fluid processing system 150 from both wellhead assembly 100A (along flowback fluid flowpath 122 of the frac tree 104 of wellhead assembly 100A) and wellhead assembly 100C. In the case of wellhead assembly 100C, flowback fluid 48 flows along alternative flowback flowpath 124 shown in FIG. 6 of the frac tree 104 of wellhead assembly 100C, where the flowback fluid 48 is supplied to fluid processing system 150 via the fluid processing conduit 82C that extends between system 150 and the hammer union adapter 112 of the frac tree 104 of wellhead assembly 100C.

Figure 7D:
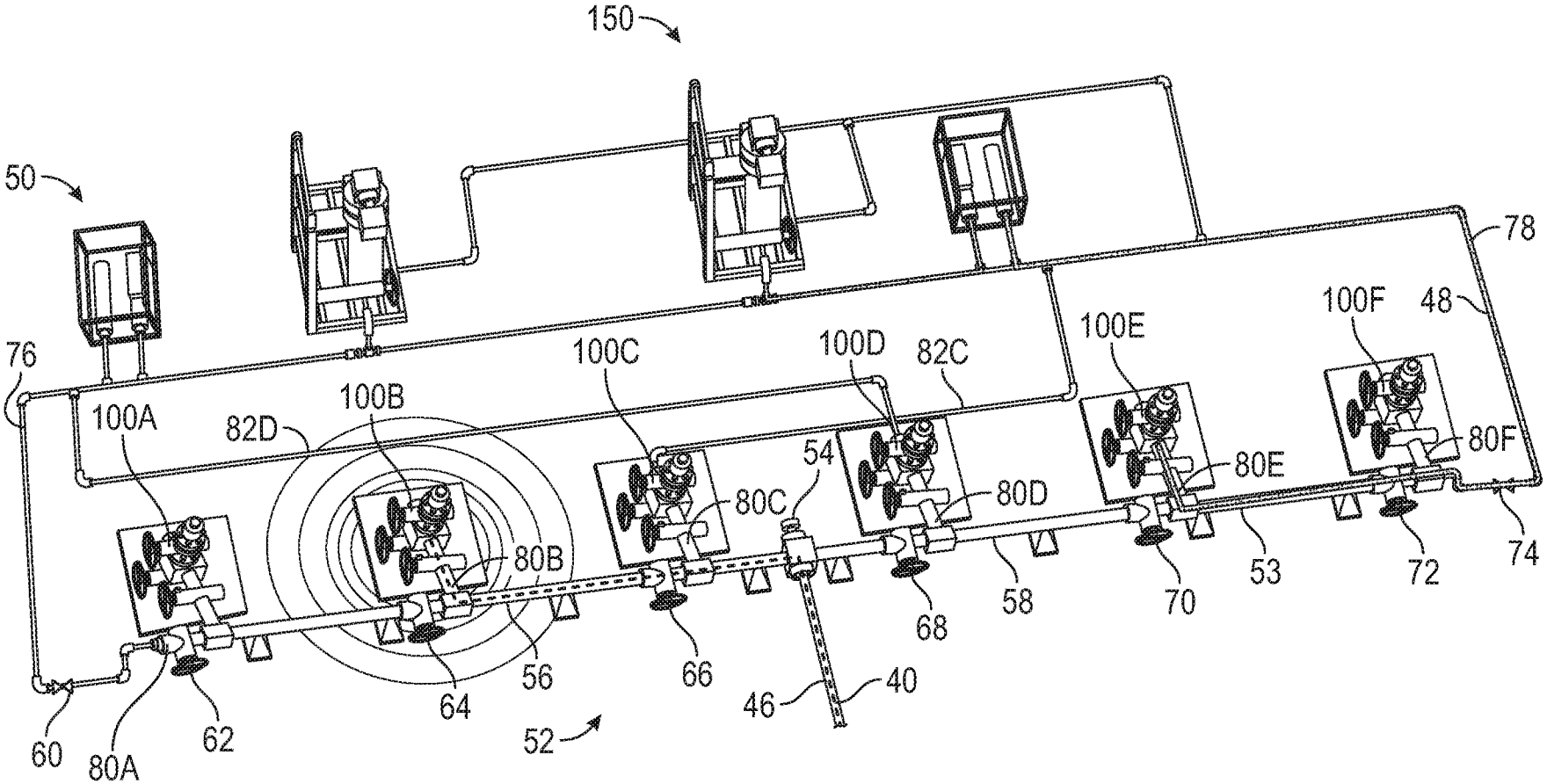
FIG. 7D is a perspective of the fracturing fluid delivery system of FIG. 3 shown in a fourth position.
Figure 7E:
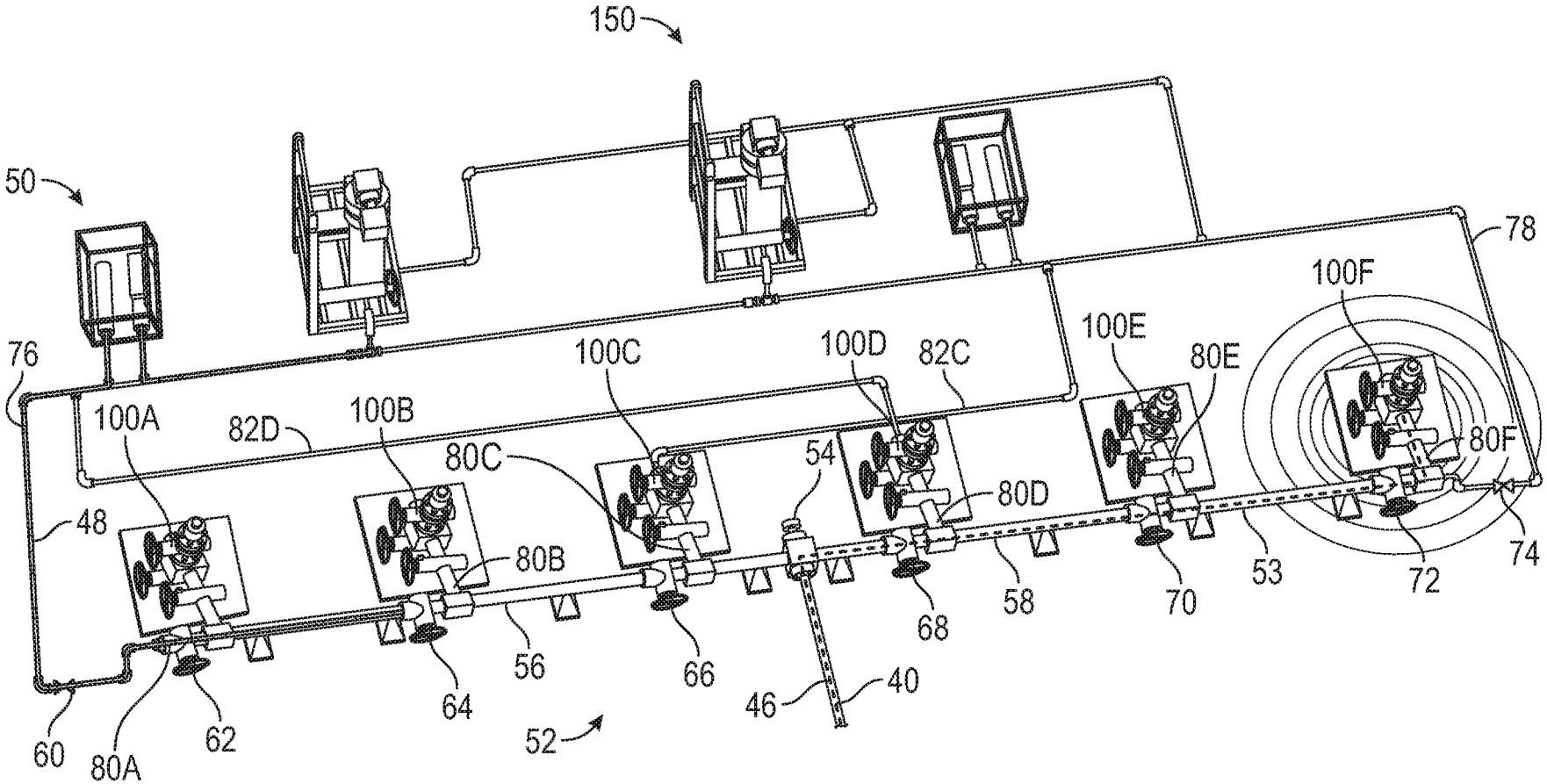
FIG. 7E is a perspective of the fracturing fluid delivery system of FIG. 3 shown in a fifth position.
Figure 7F:
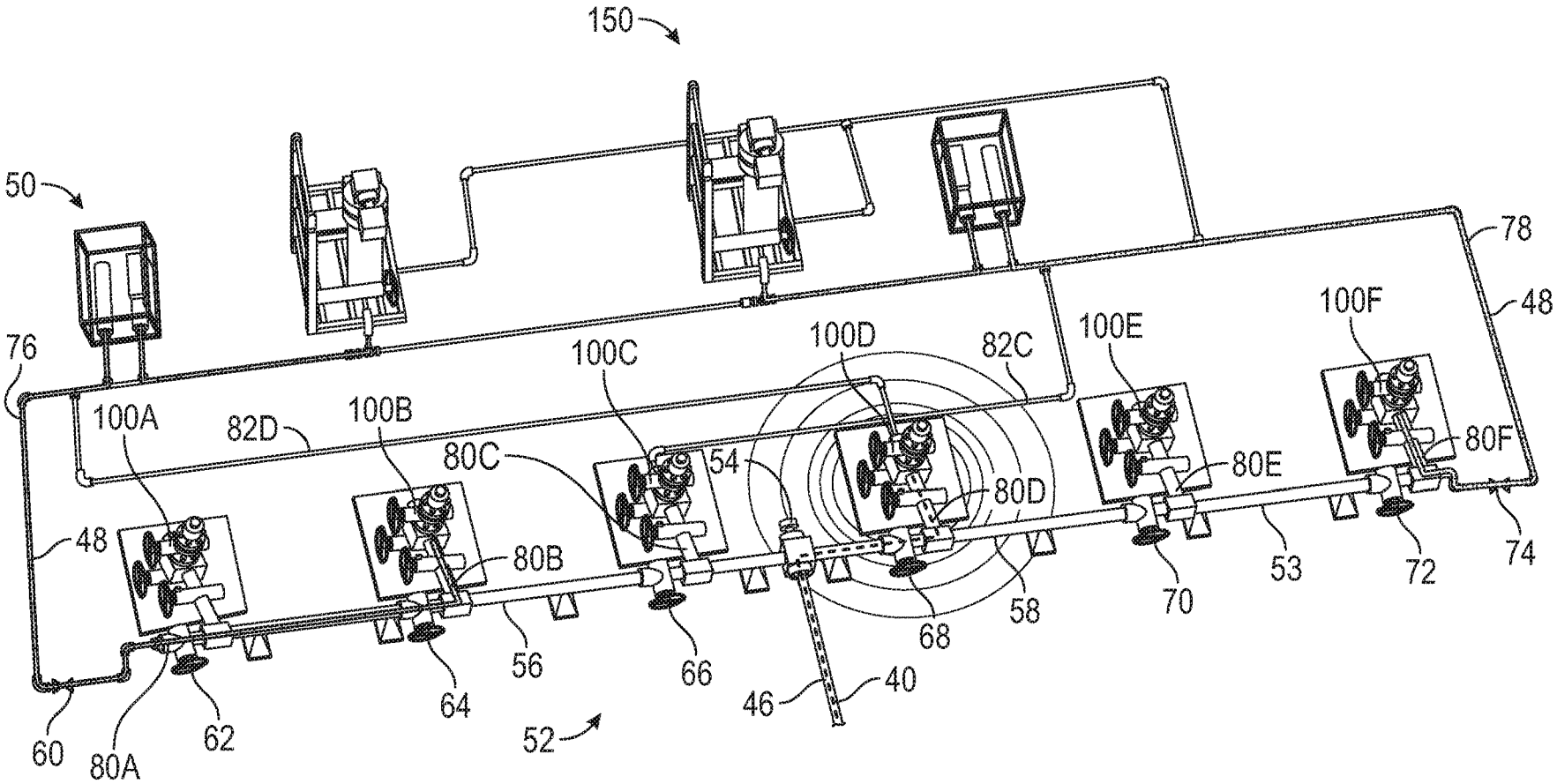
FIG. 7F is a perspective of the fracturing fluid delivery system of FIG. 3 shown in a sixth position.

As shown particularly in FIG. 7D, following the flow of a sufficient quantity of pressurized fracturing fluids 46 to the well 14 of wellhead assembly 100E, valves 62 and 68 are closed and valves 64, 66, and the branch valve 110 of the frac tree 104 of wellhead assembly 100B are opened to supply high pressure fracturing fluid 46 to the well 14 of wellhead assembly 100B via fracturing fluid flowpath 120. Concurrently, valve 70 may be closed and valve 74 opened to supply fluid processing system 150 with flowback fluids 48 from the well 14 of wellhead assembly 100E via flowback fluid flowpath 122 of the frac tree 104 of wellhead assembly 100E and second fluid processing conduit 78. As shown particularly in FIG. 7E, once the well 14 of wellhead assembly 100E has ceased to output at least a substantial amount of flowback fluid 48 to fluid processing system 150, the well 14 of wellhead assembly 100F may be supplied with pressurized fracturing fluid 46 by closing valves 66, 74, and opening valves 68, 70, and branch valve 110 of the frac tree 104 of wellhead assembly 100F, allowing the fracturing fluids 46 to enter well 14 of wellhead assembly 100F via fracturing fluid flowpath 120. Fracturing fluids 46 may be supplied to wellhead assembly 100F while allowing flowback fluids 48 to be outputted from wellhead assembly 100B by closing valve 64 and opening valve 62 to provide for fluid communication between wellhead assembly 100B and fluid processing system 150 via first fluid processing conduit 76.

Once fracturing fluids 46 have been adequately delivered to wellhead assembly 100F, flowback fluids 48 from well 14 of wellhead assembly 100F are allowed to drain to fluid processing system 150 via flowback fluid flowpath 122 and second fluid processing conduit 78 by opening valve 74 and closing valve 72. As shown particularly in FIG. 75, as flowback fluid 48 flows from both wellhead assembly 100B and wellhead assembly 100F to fluid processing system 150, pressurized fracturing fluids 46 may be delivered to wellhead assembly 100D along fracturing fluid flowpath 120 of the frac tree 104 of wellhead assembly 100D by closing valve 70 and opening branch valve 110 of the frac tree of wellhead assembly 100D to direct the fracturing fluids 46 thereto. Following the deliverance of fracturing fluids 46 to wellhead assembly 100B, flowback fluids 48 from the well 14 of wellhead assembly 100B may be delivered to fluid processing system 150 via alternative flowback flowpath 124 and fluid processing conduit 82D by closing branch valve 110 of the frac tree 104 of wellhead assembly 100D.

As described above, fracturing fluid delivery and retrieval system 50 may be utilized to fracture and retrieve flowback fluids 48 from each well 14 of system 50. Delivery system 50 is further configured to fracture wells 14 without needing to install or uninstall fluid conduits or other equipment during the fracturing operation, thereby decreasing the overall time required for performing the operation. In other words, the equipment configured for providing for the transportation of both fracturing fluids 46 and flowback fluids 48 may be installed at a single or the same time. Additionally, for at least some of the wells 14 and corresponding wellhead assemblies 100A-100F of delivery system 50, fracturing fluids 46 and flowback fluids 48 are transported along flowpaths (e.g., fluid flowpaths 120 and 122 shown in FIG. 6) comprising fluid connections that only comprise flanged connections, or in other words, do not include fluid connections formed with hammer unions, which do not allow for precise torque setting and are subject to misalignment during making up due to a lack of a positive indication of a successful connection. Further, at least some of the wells 14 and corresponding wellhead assemblies 100A-100F flow both fracturing fluids 46 and flowback fluids along the same flowpaths and through the same fluid conduits, such as through fluid conduits 80 and the branch valve 110 of frac trees 104.

Figure 8:
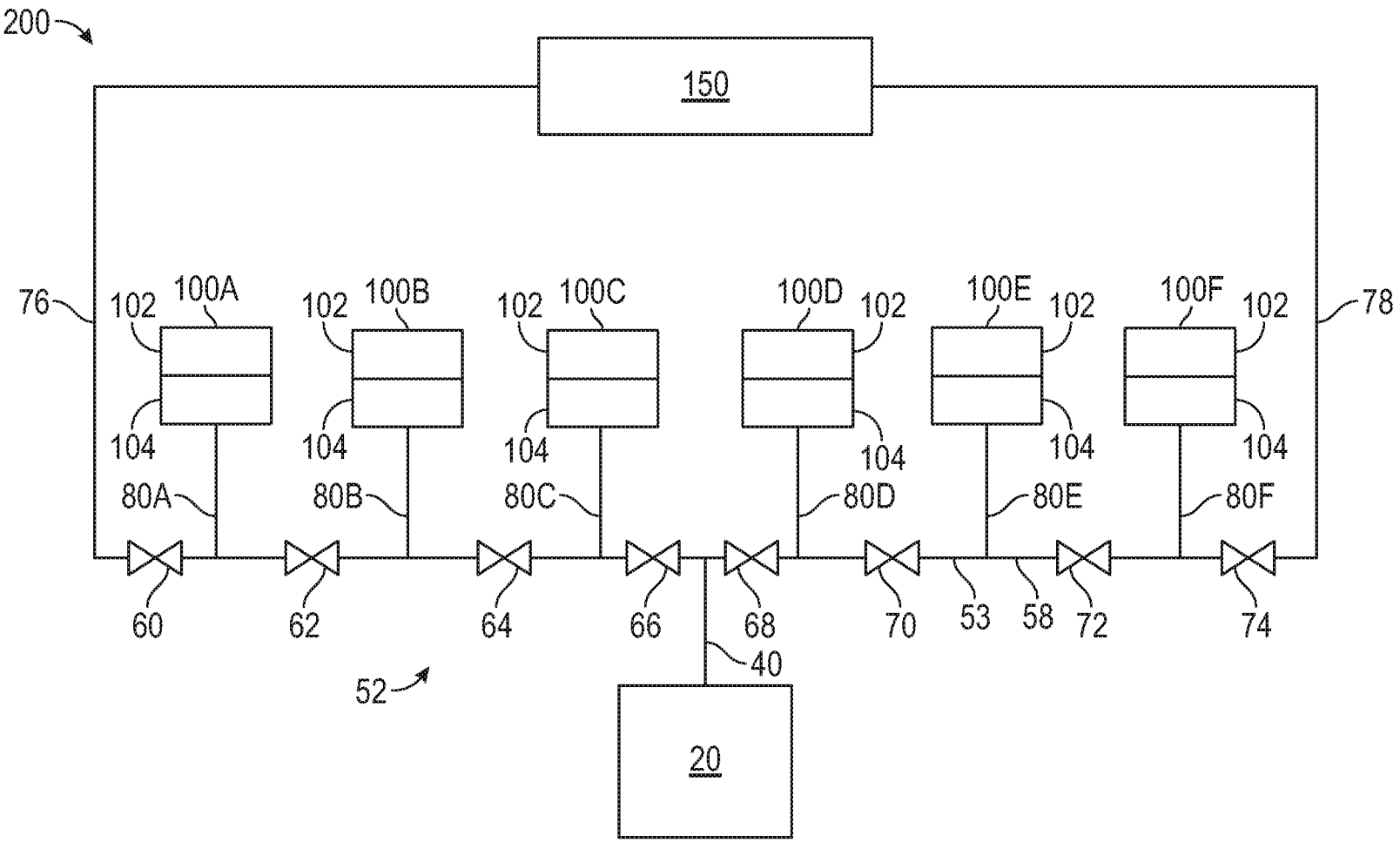
FIG. 8 is a schematic view of another embodiment of a fracturing fluid delivery system of the hydraulic fracturing system shown in FIG. 1 in accordance with principles disclosed herein.

Referring to FIG. 8, another embodiment of a fracturing fluid delivery and retrieval system 200 is shown. Fracturing fluid delivery system 200 may be used in lieu of, or in conjunction with, fluid delivery and retrieval system 50 shown in FIGS. 3-5, as part of hydraulic fracturing system 10. In some embodiments, fracturing fluid delivery system 200 may be used in a fracturing or other well stimulation system other than hydraulic fracturing system 10 described above. Fracturing fluid delivery system 200 includes features in common with fracturing fluid delivery system 50 described above, and shared features are labeled similarly. Particularly, fracturing fluid delivery system 200 includes manifold assembly 52, fluid processing conduits 76 and 78, fluid conduits 80A-80F, wellhead assemblies 100A-100F, and fluid processing system 150.

In the embodiment shown in FIG. 8, delivery system 200 differs from delivery system 50 in that system 200 does not include fluid processing conduits 82C and 82D extending between wellhead assemblies 100C and 100D, respectively, and fluid processing system 150. Instead, following the hydraulic fracturing of the wells 14 of wellhead assemblies 100C and 100D, flowback fluid is communicated from wellhead assemblies 100C and 100D to fluid processing system 150 via the flowback fluid flowpath 22 shown in FIG. 6 and fluid conduits 80C and 80D, respectively. Thus, in this embodiment, both fracturing and flowback fluids of each well 14 of delivery system 50 is flowed along flowpaths comprising only flanged connections, and thus, not including any fluid connections formed with hammer union connections. For this reason, the sequencing of the fracturing and flowback communication of the wells 14 of the wellhead assemblies 100A-100F of fracturing fluid delivery system 200 may vary from the process described above with respect to fracturing fluid delivery system 50.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A well stimulation system, comprising:
an inlet fluid conduit connected to a manifold; and
a first wellhead assembly connected to the manifold, wherein the wellhead assembly comprises:
a frac tree;
a wellhead coupled to the frac tree, wherein the wellhead is in fluid communication with a first well;
wherein the frac tree of the first wellhead assembly is configured to inlet a stimulation fluid from the manifold to the first well along a first fluid flowpath extending through a branch valve of the frac tree;
wherein the frac tree of the first wellhead assembly is configured to outlet well fluid from the first well to the manifold along the first fluid flowpath extending through the branch valve.

2. The well stimulation system of claim 1, wherein the first fluid flowpath extending through the frac tree of the first wellhead assembly comprises a plurality of fluid connections, and wherein each fluid connection comprises a flanged connection.

3. The well stimulation system of claim 1, further comprising a fluid processing system connected to the manifold, wherein the fluid processing system is configured to process well fluid from the first well.

4. The well stimulation system of claim 1, wherein the frac tree comprises:
a connector block;
a lower valve coupled to the connector block; and
an upper valve coupled to the connector block in series with the lower valve;
wherein the branch valve is coupled to the connector block between the lower valve and the upper valve.

5. The well stimulation system of claim 4, wherein the first fluid flowpath extends between the branch valve and the lower valve of the frac tree.

6. The well stimulation system of claim 4, wherein the upper valve of the frac tree is configured to allow for the passage of a tubular member through the frac tree into the first well.

7. The well stimulation system of claim 4, wherein the frac tree comprises a cap coupled to the upper valve.

8. The well stimulation system of claim 4, wherein the frac tree comprises a hammer union adapter coupled to with the connector block.

9. A well stimulation system, comprising:
an inlet fluid conduit connected to a manifold; and
a first wellhead assembly connected to the manifold, wherein the wellhead assembly comprises:
a first frac tree;
a first wellhead coupled to the first frac tree, wherein the first wellhead is in fluid communication with a first well;
wherein the first frac tree is configured to inlet a stimulation fluid from the manifold to the first well along a first fluid flowpath that extends through a branch valve of the first frac tree and comprises a plurality of fluid connections, wherein each fluid connection comprises a flanged connection;

wherein the first frac tree is configured to outlet well fluid from the first well to the manifold along the first fluid flowpath extending through the branch valve;

wherein a fluid line extends from the manifold to the branch valve of the first frac tree, and wherein the fluid line is coupled to the branch valve by a flanged connection.

10. The well stimulation system of claim 9, wherein the first frac tree is configured to outlet well fluid from the first well to the manifold along the first fluid flowpath.

11. The well stimulation system of claim 9, further comprising a second wellhead assembly connected to the manifold, wherein the second wellhead assembly comprises:

a second frac tree; and a second wellhead coupled to the second frac tree, wherein the second wellhead is in fluid communication with a second well;

wherein the second frac tree is configured to inlet a stimulation fluid from the manifold to the second well along a second fluid flowpath that comprises a plurality of fluid connections, wherein each fluid connection comprises a flanged connection.

12. The well stimulation system of claim 11, wherein both the first and second flowpaths extend through the manifold.

13. The well stimulation system of claim 11, further comprising a fluid processing system connected to the manifold, wherein the fluid processing system is configured to process well fluid from the first well and the second well.

14. The well stimulation system of claim 13, further comprising a first fluid processing conduit extending between the manifold and the fluid processing system, wherein the first fluid processing conduit is configured to supply the fluid processing system with well fluid from the first well.

15. The well stimulation system of claim 13, further comprising a second fluid processing conduit extending between the second frac tree and the fluid processing system, wherein the second fluid processing conduit is configured to supply the fluid processing system with well fluid from the second well.

16. The well stimulation system of claim 9, wherein the first frac tree comprises:

a connector block;

a lower valve coupled to the connector block; and an upper valve coupled to the connector block in series with the lower valve;

wherein the branch valve is coupled to the connector block between the lower valve and the upper valve.

17. The well stimulation system of claim 16, wherein the first fluid flowpath extends between the branch valve and the lower valve of the first frac tree.

18. A method for stimulating a well, comprising:

flowing a stimulation fluid into the well from a manifold through a first fluid flowpath extending through a fluid line connected to the manifold, and through a branch valve of a frac tree coupled to the fluid line, wherein a wellhead in fluid communication to the well is coupled to the frac tree; and flowing a well fluid out of the well to the manifold through the first fluid flowpath that extends through the branch valve of the frac tree and the fluid line.

19. The method of claim 18, wherein the first fluid flowpath comprises only flanged fluid connections.

20. The method of claim 18, further comprising flowing the stimulation fluid through a connector block of the frac tree, and a lower valve of the frac tree along the first fluid flowpath.

* * * * *